US012320212B2

(12) United States Patent
Todd et al.

(10) Patent No.: US 12,320,212 B2
(45) Date of Patent: Jun. 3, 2025

(54) DIE ADAPTOR AND METHOD

(71) Applicant: M & M Oil Tools, LLC, Breaux Bridge, LA (US)

(72) Inventors: Andy Paul Todd, Lafayette, LA (US); Brad Indest, Breaux Bridge, LA (US); Sythonh Sysavath, Breaux Bridge, LA (US); Joseph Wertz, Duson, LA (US)

(73) Assignee: M&M Oil Tools, LLC, Breaux Bridge, LA (US)

( * ) Notice: Subject to any disclaimer, the term of this patent is extended or adjusted under 35 U.S.C. 154(b) by 0 days.

(21) Appl. No.: 18/584,833

(22) Filed: Feb. 22, 2024

(65) Prior Publication Data

US 2024/0279990 A1 Aug. 22, 2024

Related U.S. Application Data

(60) Provisional application No. 63/385,803, filed on Feb. 22, 2023.

(51) Int. Cl.
*E21B 19/16* (2006.01)

(52) U.S. Cl.
CPC ..... *E21B 19/161* (2013.01)

(58) Field of Classification Search
CPC ..... E21B 19/161
See application file for complete search history.

(56) References Cited

U.S. PATENT DOCUMENTS 1,855,143 A * 4/1932 Williams ..... E21B 19/161 81/106
3,085,508 A * 4/1963 Hurwitz ..... A43D 95/14 101/384
3,589,742 A * 6/1971 Flick ..... E21B 19/164 269/235
4,404,876 A * 9/1983 Eckel ..... E21B 19/164 81/57.21
4,437,654 A * 3/1984 Chiappetti ..... B25B 1/103 269/283

(Continued)

FOREIGN PATENT DOCUMENTS

CN 109577884 A * 4/2019 ..... E21B 19/161
DE 102020207368 B4 4/2022

(Continued)

OTHER PUBLICATIONS

International Search Report and Written Opinion, mailed Jun. 17, 2024, for corresponding International Patent Application No. PCT/US2024/016949.

*Primary Examiner* — Aaron L Lembo
(74) *Attorney, Agent, or Firm* — Jones Walker LLP

(57) ABSTRACT

An adapted die carrier assembly for a gripping device includes a conventional die carrier, a die adapter, and an alternate die that is not configured to directly engage die receptacles of the conventional die carrier. The die adapter is secured to the conventional die carrier, and the alternate die is secured to the die adapter. The die adapter includes a receiving slot and one or more lobes. Each lobe is slidingly secured within one of the die receptacles of the conventional die carrier. Each lobe has an outer surface that is reciprocal to the die receptacles. The alternate die is slidingly secured within the receiving slot of the die adapter. The alternate die includes a gripping surface.

32 Claims, 9 Drawing Sheets

(56) References Cited

U.S. PATENT DOCUMENTS 4,462,581 A * 7/1984 Mitani ..... B25B 1/2447 269/283
5,095,830 A * 3/1992 Love ..... B31F 1/08 101/393
5,176,023 A * 1/1993 Baldwin ..... B21D 5/0209 72/446
6,070,500 A * 6/2000 Dlask ..... E21B 19/161 81/57.33
6,152,435 A * 11/2000 Snell ..... B25B 1/2452 269/282
6,631,792 B2 * 10/2003 Buck ..... E21B 19/10 188/189
6,637,296 B1 * 10/2003 Dagenais ..... E21B 19/161 81/185.1
10,047,575 B2 * 8/2018 Tveter ..... E21B 19/16
10,247,279 B2 * 4/2019 Scekic ..... F16H 57/082
10,309,169 B2 * 6/2019 Scekic ..... B21D 39/046
10,538,976 B2 * 1/2020 Scekic ..... E21B 19/163
10,557,321 B2 * 2/2020 Scekic ..... E21B 19/20
10,718,171 B2 * 7/2020 McCorriston ..... E21B 19/161
2003/0066718 A1 * 4/2003 Buck ..... E21B 19/10 188/67
2011/0023573 A1 * 2/2011 Intagliata ..... B21D 39/048 72/367.1
2014/0262538 A1 * 9/2014 Louviere ..... E21B 19/10 175/423
2024/0279990 A1 * 8/2024 Todd ..... E21B 19/161

FOREIGN PATENT DOCUMENTS

NO 20200807 A1 1/2021
SE 2151141 A1 4/2023
WO WO-2008113113 A1 * 9/2008 ..... E21B 17/1085

* cited by examiner

DIE ADAPTOR AND METHOD

CROSS-REFERENCE TO RELATED APPLICATION

This application is a nonprovisional of, and claims the benefit of and priority to, U.S. Provisional Patent Application No. 63/385,803, filed on Feb. 22, 2023, which is incorporated herein by reference in its entirety.

BACKGROUND

Gripping machines, such as iron roughnecks, are used in the oil and gas industry for making up and breaking apart tubular connections. The gripping machines hold the tubular segments by engaging the outer surface of each tubular segment with gripping surfaces of dies secured within die carriers. Each conventional die carrier used in a gripping machine is configured to receive and retain dies that have a particular shape and/or configuration. Certain types of dies may not provide the desired gripping performance in some applications. For example, certain cylindrical dies may rotate within die receptacles of conventional die carriers, which can reduce the die's ability to grip the outer surface of a tubular segment. Accordingly, distinct types of dies may be desired in certain applications. However, if a user wishes to use a die that does not fit or cooperate with the conventional die carrier secured to the gripping machine, the user is required to remove the conventional die carrier from the gripping machine and replace it with a different die carrier that is configured to accommodate the desired die. One disadvantage of this process is the cost of the new die carrier for the desired die. Another disadvantage of this process is the time required to replace the die carrier connected to the gripping machine with the new die carrier.

Accordingly, there is a need for a device and method for using a different die without disconnecting and/or replacing a conventional die carrier that is secured to a gripping machine.

BRIEF DESCRIPTION OF THE DRAWING VIEWS

DETAILED DESCRIPTION OF SELECTED EMBODIMENTS

An adapted die carrier assembly includes a die adapter and a conventional die carrier of a gripping device, such as an iron roughneck. The conventional die carrier includes one or more die receptacles each designed to receive a particular die having a gripping surface configured to engage and grip an object, such as a pipe. In the adapted die carrier assembly, the die adapter engages the conventional die carrier's one or more die receptacles. The die adapter also receives and retains an alternate die, which is not configured to engage the die receptacles of the conventional die carrier. In some embodiments, a die spacer or an adapter plate secures the alternate die to the die adapter, and one or more retaining plates secure the die adapter to the conventional die carrier. In certain embodiments, the die adapter receives and retains two or more alternate dies, each of which is not configured to engage the die receptacles of the conventional die carrier. FIGS. 1-13 illustrate embodiments of the adapted die carrier assembly and the die adapter.

Figure 1:
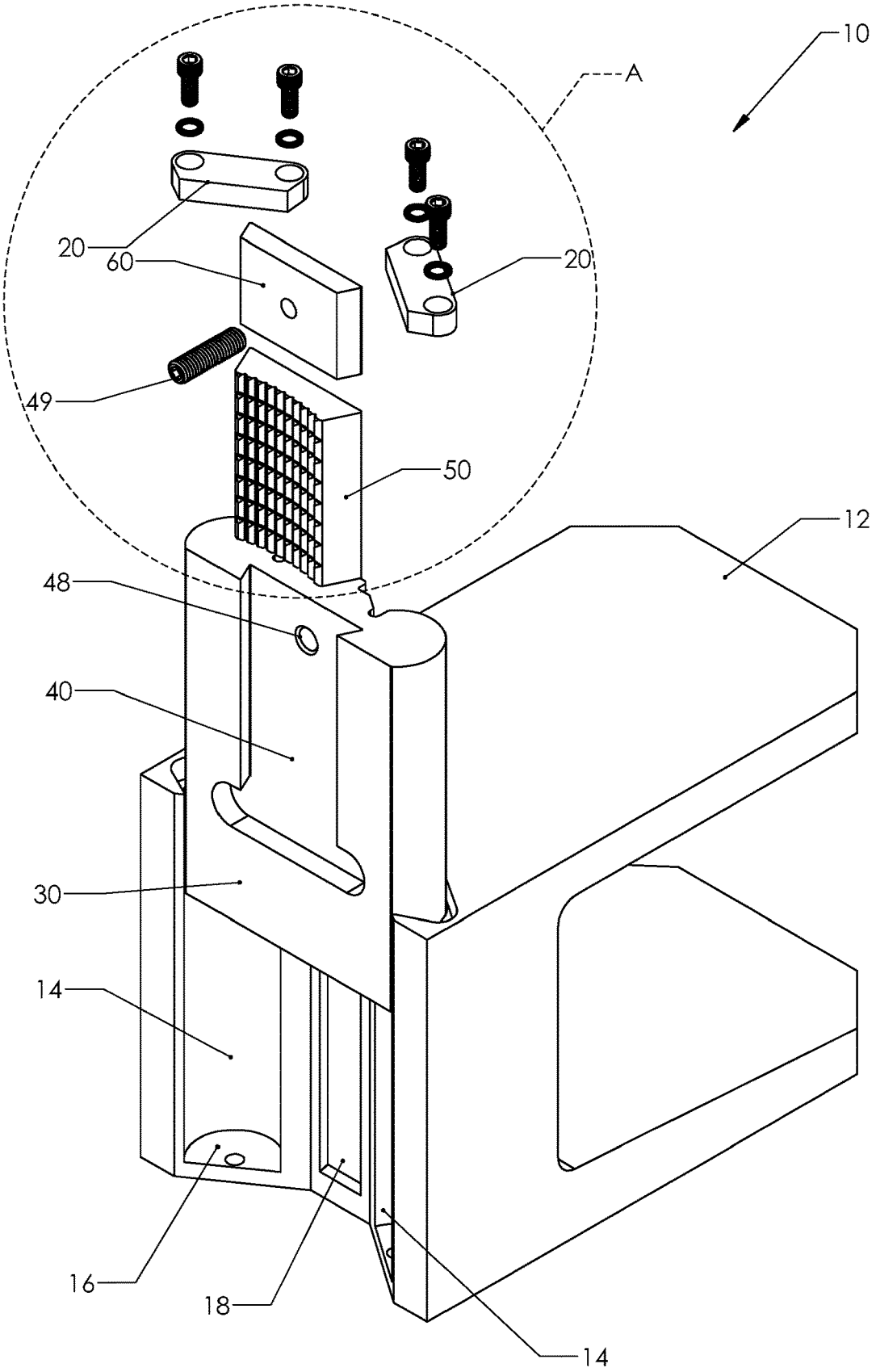
FIG. 1 is an exploded perspective view of an adapted die carrier assembly including a die adapter and a conventional die carrier.
Figure 2:
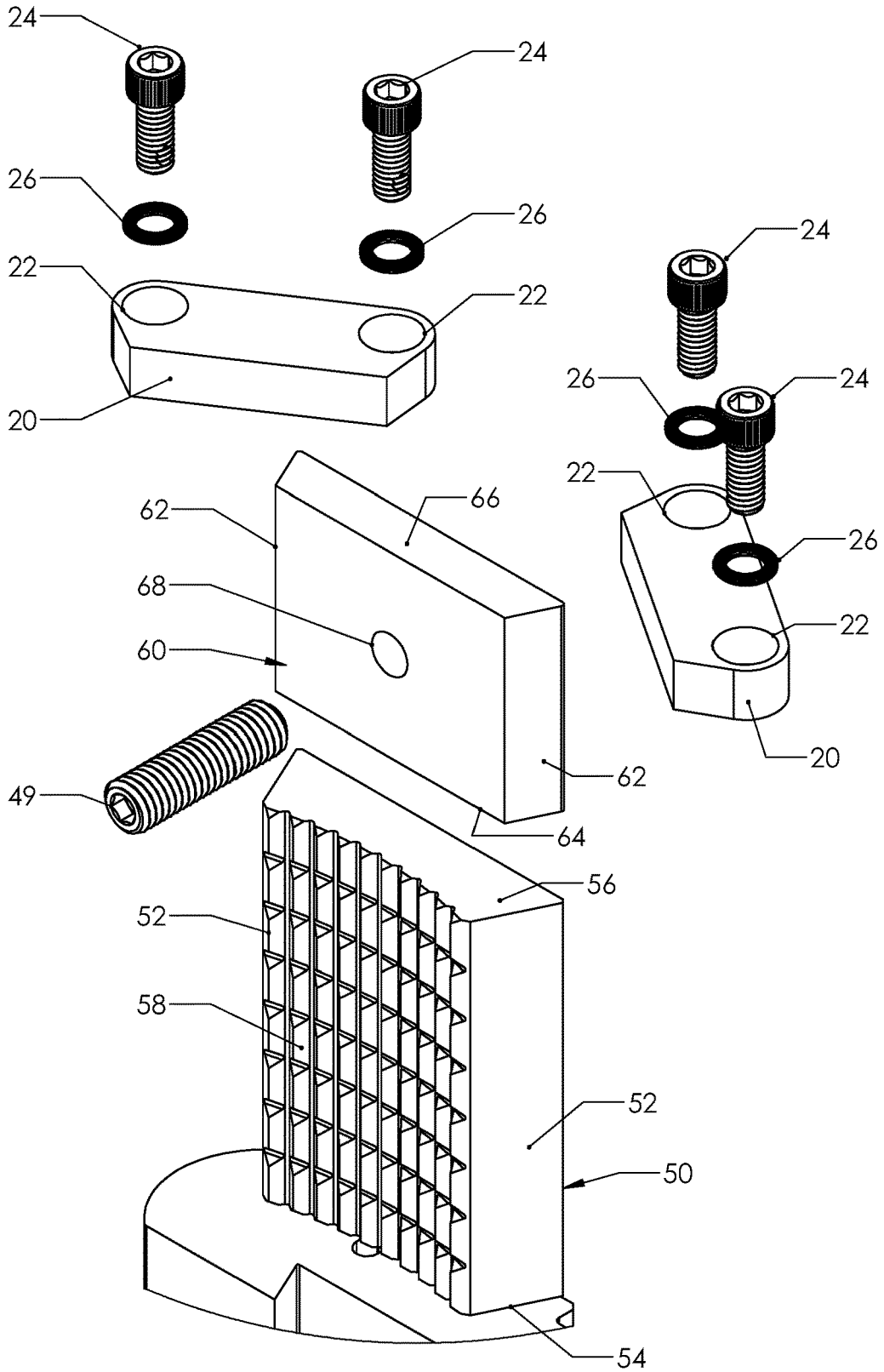
FIG. 2 is a detail view taken from section A in FIG. 1.

With reference to FIGS. 1-2, adapted die carrier assembly 10 includes conventional die carrier 12, die adapter 30, and alternate die 50. Die adapter 30 is slidingly connected to conventional die carrier 12, with alternate die 50 slidingly connected to die adapter 30. In the illustrated embodiment, die spacer 60 secures alternate die 50 to die adapter 30, while retaining plates 20 secure die adapter 30 to conventional die carrier 12. Some embodiments of adapted die carrier assembly 10 include other mechanisms for securing alternate die 50 to die adapter 30 and for securing die adapter 30 to conventional die carrier 12. In this way, adapted die carrier assembly 10 modifies conventional die carrier 12 for use with at least one alternate die 50, which is not configured to directly engage conventional die carrier 12.

Conventional die carrier 12 may include one or more die receptacles 14 and a central recess 18. The die receptacles 14 are each configured to receive a conventional die. In some embodiments, die receptacles 14 may have a lower surface 16, an open upper end, a side surface that has a generally cylindrical shape, and an opening extending from the lower surface 16 to the open upper end. In these embodiments, the die receptacles 14 are each configured to receive a conventional die that has a generally cylindrical shape. In the illustrated embodiment, conventional die carrier 12 includes two die receptacles 14.

Figure 3:
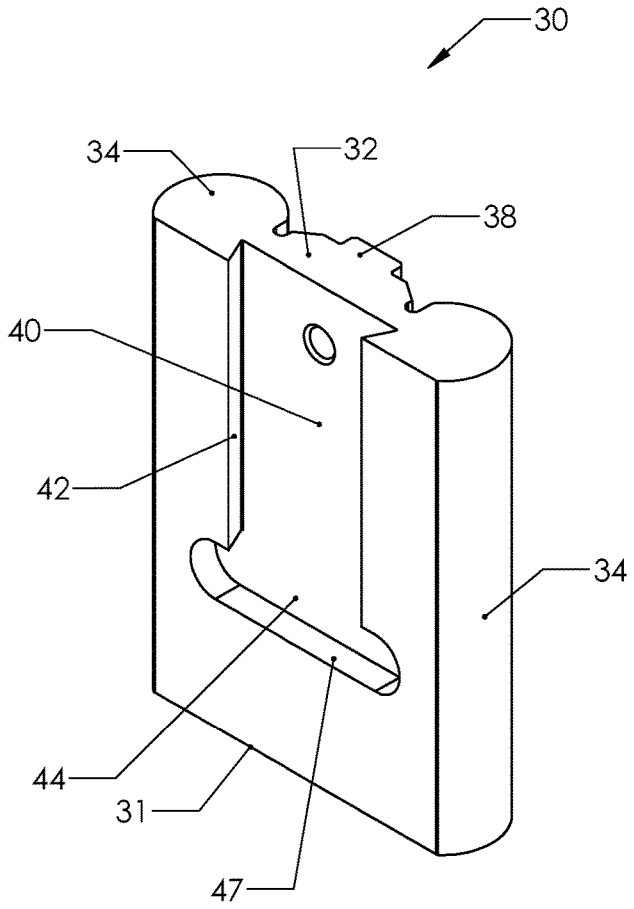
FIG. 3 is a perspective view of the die adapter.
Figure 4:
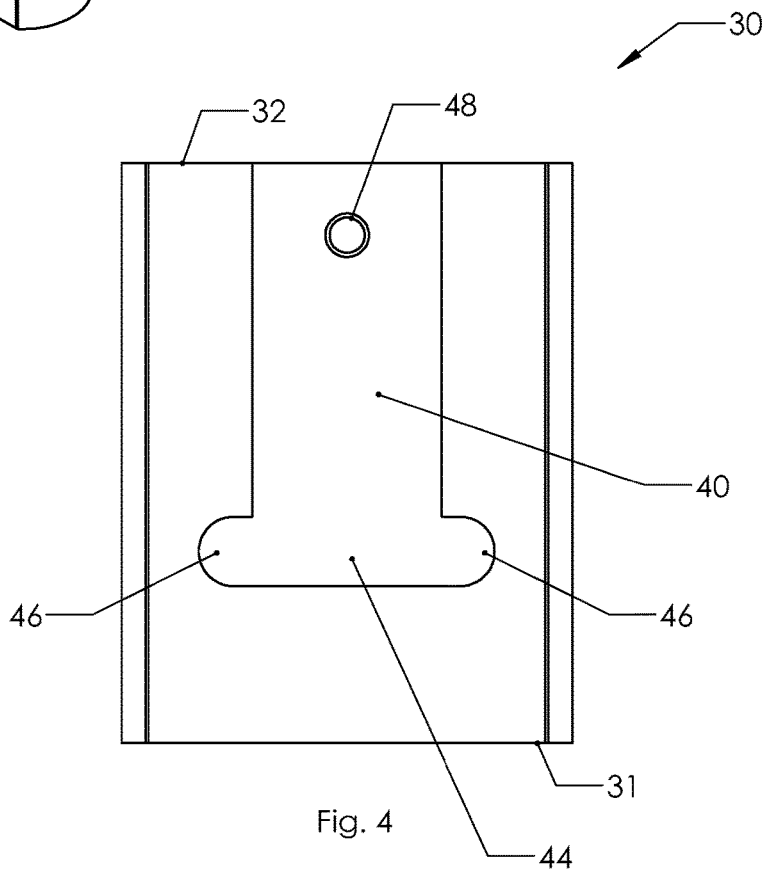
FIG. 4 is a front view of the die adapter.
Figure 5:
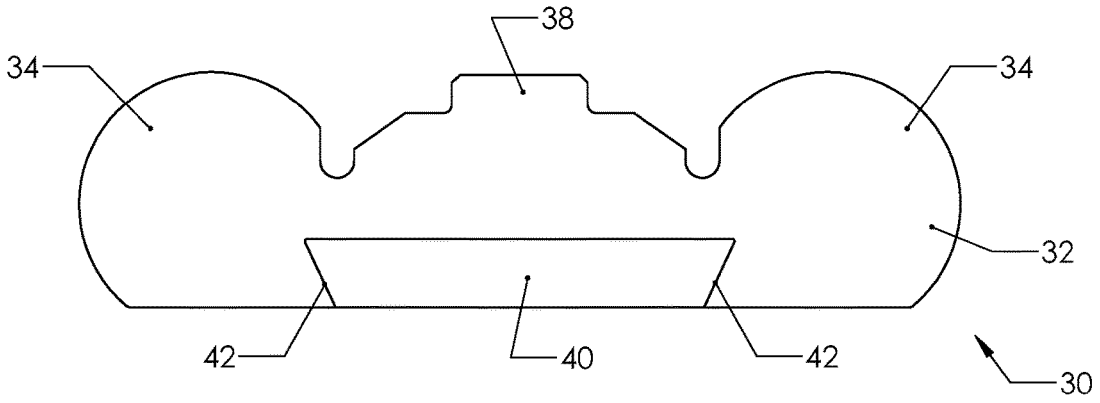
FIG. 5 is a top view of the die adapter.

Referring now to FIGS. 3-5, die adapter 30 includes one or more lobes 34 extending from lower end 31 of die adapter 30 to upper end 32 of die adapter 30. Each lobe 34 has an outer surface that is reciprocal in shape to the shape of the die receptacles 14 of conventional die carrier 12. In this way, each lobe 34 is configured to slidingly engage one of the die receptacles 14 of conventional die carrier 12. In the illustrated embodiment, die adapter 30 includes two lobes 34, each having a generally cylindrical outer surface. In other embodiments, lobes 34 may have outer surfaces with other shapes reciprocal to the die receptacles 14, such as elliptical, square, triangular, polygonal, or any other shape. Die adapter 30 may also include central protrusion 38, which optionally extends the entire length from lower end 31 to upper end 32. Central protrusion 38 may have a profile that is reciprocal to a profile of central recess 18 of conventional die carrier 12. In this way, central protrusion 38 is configured to slidingly engage the central recess 18 of conventional die carrier 12. Central protrusion 38 and both lobes 34 may be positioned on a rear side of die adapter 30, with lobes 34 extending to and defining the sides of die adapter 30.

With reference still to FIGS. 3-5, a front side of die adapter 30 includes receiving slot 40. Receiving slot 40 extends from the upper end 32 of die adapter 30 to lower surface 47. Receiving slot 40 may include tapered side surfaces 42, which provide a width that varies across the depth of the receiving slot 40. Specifically, the width may increase from the front surface of die adapter 30 to the back surface of receiving slot 40. In other words, the receiving slot's inner portion has a larger width than the receiving slot's outer portion. Receiving slot 40 has an open face between tapered side surfaces 42 at the front surface of die adapter 30. Optionally, the lower portion 44 of receiving slot 40 may include expansion pockets 46 on both sides of receiving slot 40. In this way, the lower surface 47 of the receiving slot 40 has a larger width than the open upper end of the receiving slot 40. The expansion pockets 46 may allow a lower surface of alternate die 50 to directly engage the lower surface 47 of receiving slot 40 regardless of the manufacturing radius of the lower corners of alternate die 50 (shown in FIG. 6).

In some embodiments, die adapter 30 further includes bore 48 extending from the back surface of receiving slot 40 to a rear surface of die adapter 30. In certain embodiments, bore 48 has a threaded surface configured to engage the threads of fastener 49 (shown in FIGS. 1 and 2). Fastener 49 may be a screw, bolt, or any other threaded cylindrical device. In one embodiment, fastener 49 is a flat-tip set screw.

With reference now to FIG. 2, alternate die 50 of adapted die carrier assembly 10 may include tapered side surfaces 52 extending from lower end 54 to upper end 56. Tapered side surfaces 52 of alternate die 50 may have a reciprocal shape and configuration to tapered side surfaces 42 of receiving slot 40 in die adapter 30. In this way in the illustrated embodiment, die adapter 30 and its receiving slot 40 is configured to slidingly receive and retain alternate die 50. Gripping surface 58 of alternate die 50 includes pyramid tooth projections. In the illustrated embodiment, the pyramid tooth projections of gripping surface 58 extend from lower end 54 to upper end 56. Additionally, gripping surface 58 may have a concave curved profile that is generally reciprocal to an outer surface of a tubular segment for improved gripping effectiveness. In other embodiments, alternate die 50 of adapted die carrier assembly 10 may be any die configured for gripping a pipe or other surface that is not configured to be received within die receptacles 14 of conventional die carrier 12. As used herein, "alternate die" means any gripping surface tool that does not fit into, or cannot be received and/or retained in, the conventional die carrier of the adapted die carrier assembly.

Referring still to FIG. 2, die spacer 60 of adapted die carrier assembly 10 may also include tapered side surfaces 62 extending from lower end 64 to upper end 66. Tapered side surfaces 62 of die spacer 60 may have a reciprocal shape and configuration to tapered side surfaces 42 of receiving slot 40 in die adapter 30. In this way in the illustrated embodiment, die adapter 30 and its receiving slot 40 is configured to slidingly receive and retain alternate die 50. In some embodiments, die spacer 60 includes bore 68 configured to receive fastener 49. In certain embodiments, bore 68 of die spacer 60 includes a threaded surface configured to engage the threaded external surface of fastener 49. In an assembled configuration, bore 68 of die spacer 60 may align with bore 48 of die adapter 30.

FIG. 2 also illustrates retaining plates 20 of adapted die carrier assembly 10. Each retaining plate 20 includes apertures 22. Each aperture 22 is configured to receive fastener 24 and optionally washer 26. Fasteners 24 may be screws, bolts, or any other suitable securing mechanism as readily understood by skilled artisans.

Figure 6:
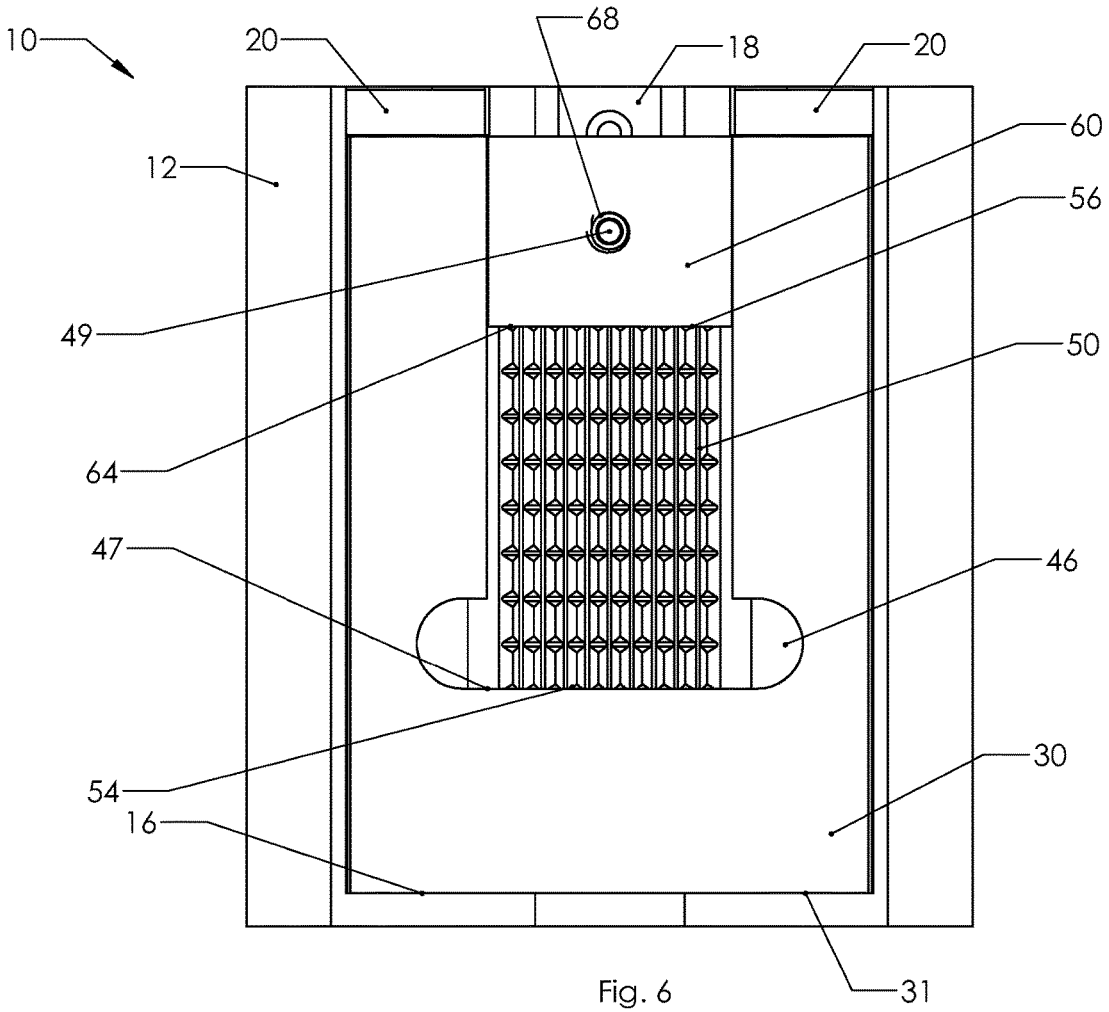
FIG. 6 is a front view of the adapted die carrier assembly in FIG. 1.

With reference to FIGS. 1 and 6, adapted die carrier assembly 10 is assembled by slidingly connecting die adapter 30 to conventional die carrier 12. Specifically, each lobe 34 of die adapter 30 slides into one of the reciprocally shaped die receptacles 14 of conventional die carrier 12 until lower end 31 of die adapter 30 directly engages bottom surfaces 16 of the die receptacles 14 in conventional die carrier 12. Central protrusion 38 of die adapter 30 may also slide into and engage reciprocally shaped central recess 18 of conventional die carrier 12. Die adapter 30 is secured to conventional die carrier 12 by positioning retaining plates 20 over upper end 32 of die adapter 30, then securing retaining plates 20 to conventional die carrier 12 with fasteners 24.

Figure 7:
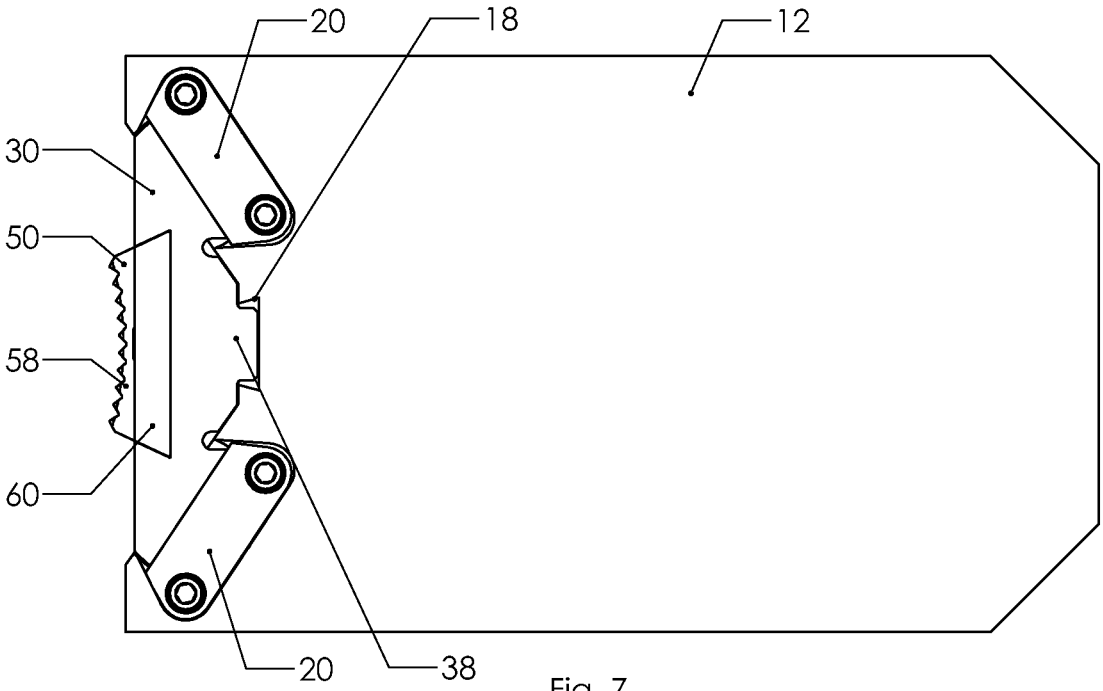
FIG. 7 is a top view of the adapted die carrier assembly.
Figure 8:
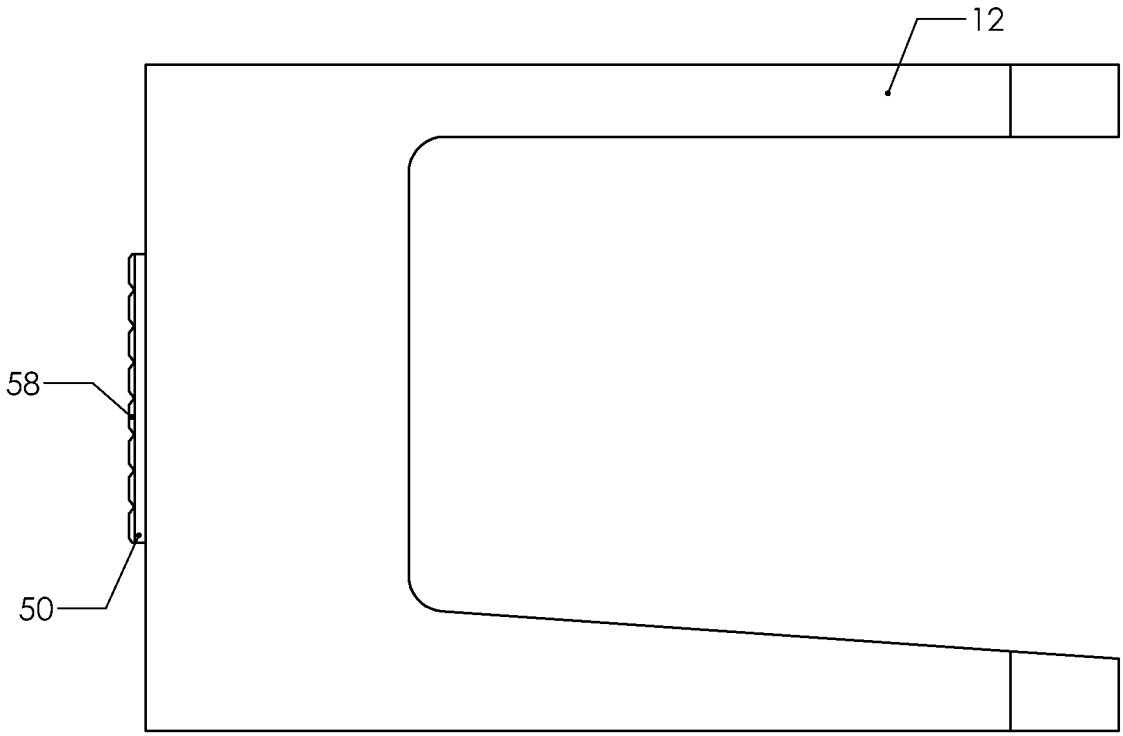
FIG. 8 is a side view of the adapted die carrier assembly.

Next, alternate die 50 is slidingly connected to die adapter 30. Specifically, alternate die 50 slides into receiving slot 40 of die adapter 30, with tapered side surfaces 52 of alternate die 50 engaging tapered side surfaces 42 of receiving slot 40, until lower end 54 of alternate die 50 directly engages lower surface 47 of receiving slot 40. As shown in FIGS. 7 and 8, gripping surface 58 of alternate die 50 extends forward through the open face of receiving slot 40 in the assembled configuration. In other embodiments, one or more additional alternate dies may be slid into receiving slot 40 of die adapter 30 above alternate die 50 in order to retain two or more alternate dies with die adapter 30.

Finally, alternate die 50 is secured within receiving slot 40 of die adapter 30. In the illustrated embodiment, alternate die 50 is secured within receiving slot 40 by sliding die spacer 60 into receiving slot 40, with tapered side surfaces 62 of die spacer 60 engaging tapered side surfaces 42 of receiving slot 40, until lower end 64 of die spacer 60 directly engages upper end 56 of alternate die 50. Fastener 49 is secured through and engages bore 68 of die spacer 60 and bore 48 of die adapter 30 (shown in FIG. 11). In other embodiments, alternate die 50 may be slidingly connected and/or secured to die adapter 30 before die adapter 30 is connected to conventional die carrier 12. The alternate die may be any die configured for gripping a pipe or other surface. In other embodiments, the alternate die may be secured to the die adapter without a die spacer. For example, the alternate die may include a bore for receiving a fastener to secure the alternate die to the die adapter without a die spacer.

Figure 9:
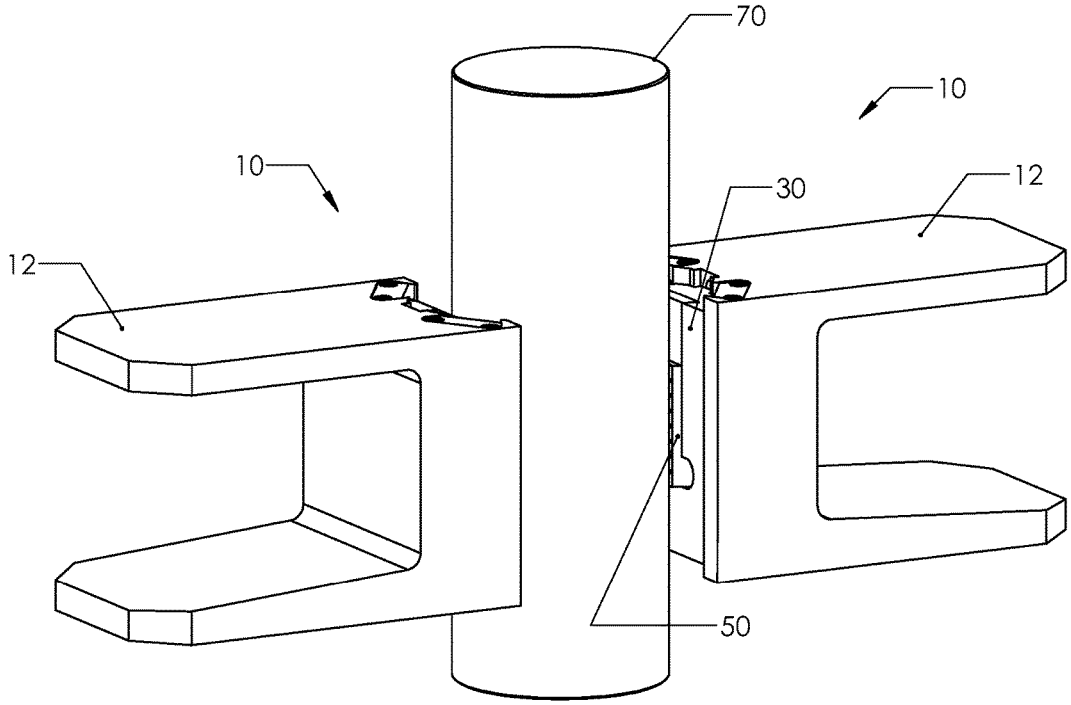
FIG. 9 is a perspective schematic view of two adapted die carrier assemblies in use for gripping a pipe segment.
Figure 10:
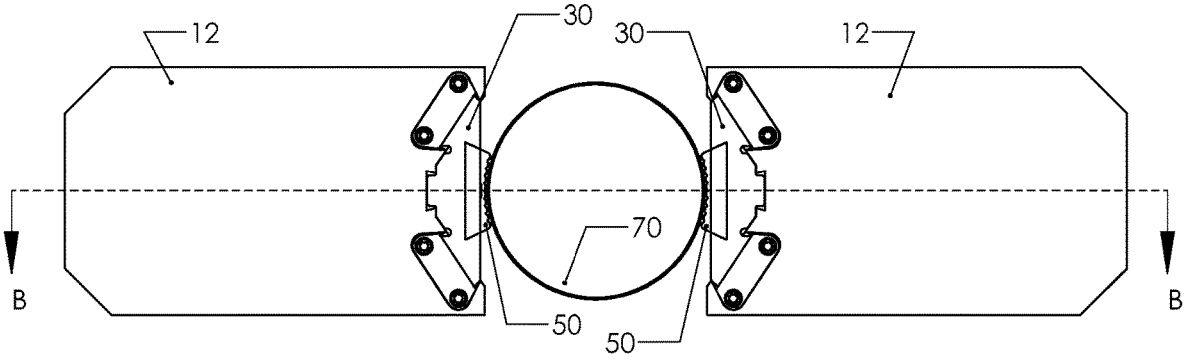
FIG. 10 is a top schematic view of the two adapted die carrier assemblies engaging the pipe segment.
Figure 11:
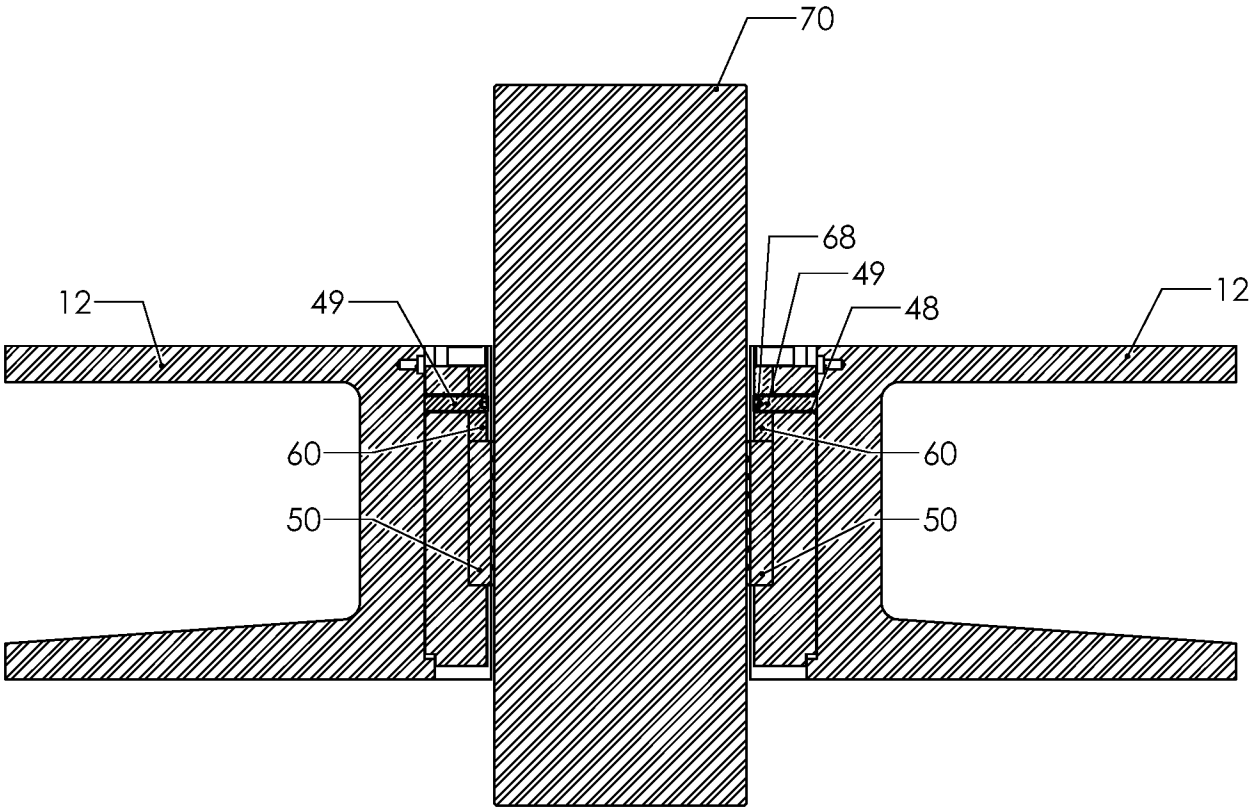
FIG. 11 is a sectional view of the two adapted die carrier assemblies engaging the pipe segment taken along line B-B in FIG. 10.

Referring now to FIGS. 9-11, adapted die carrier assembly 10 may be used in a variety of gripping devices to grip an outer surface of an object. For example, two die carrier assemblies 10 may be used in a gripping device to grip an outer surface of pipe segment 70. For example, the gripping device may be an iron roughneck. Adapted die carrier assemblies 10 may be adapted upper jaws and/or adapted lower jaws of the iron roughneck. The gripping device applies a force on each adapted die carrier assembly 10 in a direction toward pipe segment 70 such that gripping surface 58 of alternate die 50 engages the outer surface of pipe segment 70, such as for the purpose of holding pipe segment 70 stationary while it is secured to, or disengaged from, a second pipe segment (not pictured).

Die adapter 30 enables use of an alternate die, such as alternate die 50, in a gripping device, such as an iron roughneck, without removing or replacing an existing conventional die carrier 12 that is already secured to the gripping device but configured for use with a different type of die. Accordingly, a method of modifying a conventional die carrier 12 includes securing die adapter 30 to conventional die carrier 12 and securing alternate die 50 to die adapter 30 to use alternate die 50 with conventional die carrier 12 in a gripping device.

Figure 12:
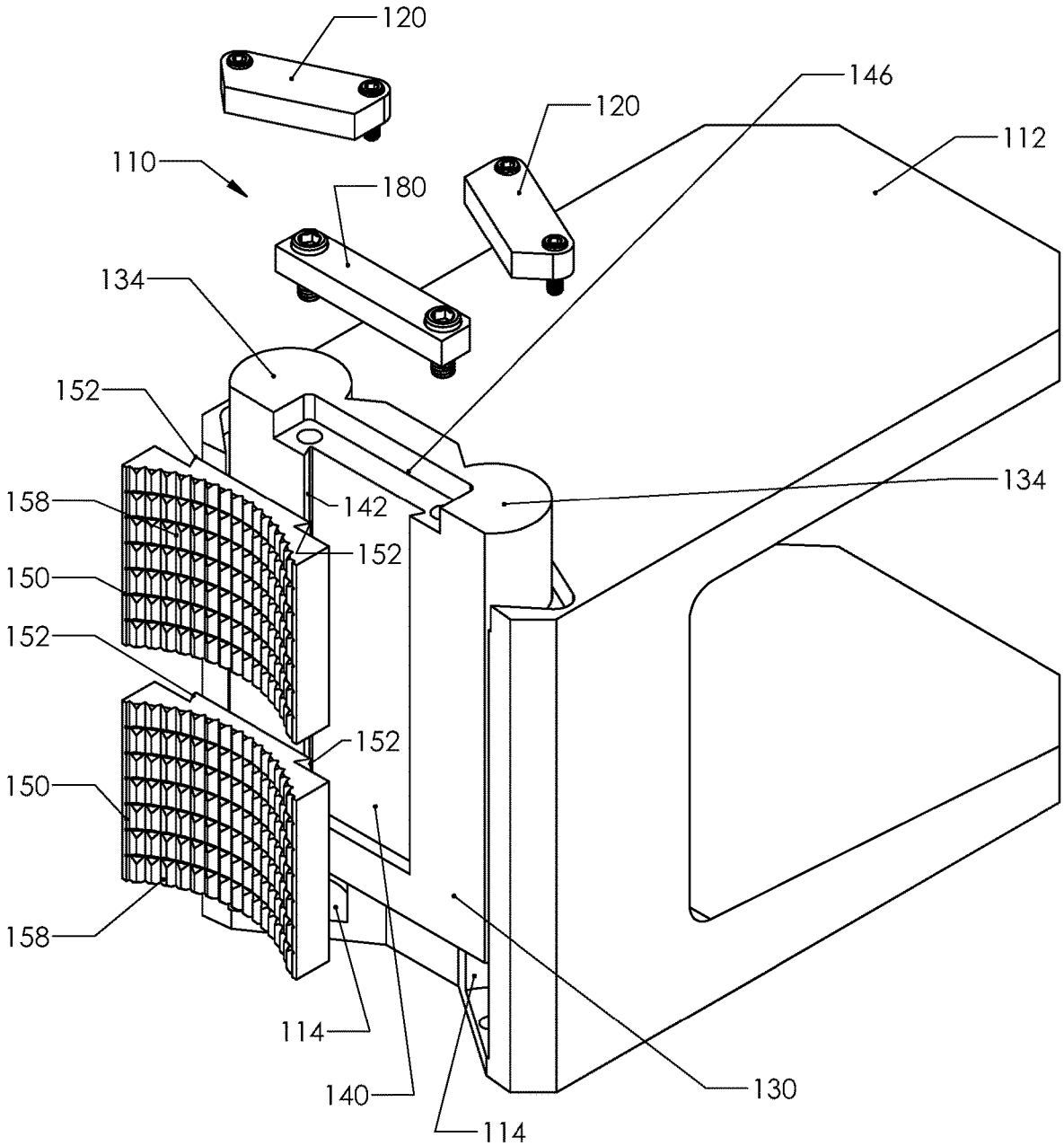
FIG. 12 is an exploded perspective view of an adapted die carrier assembly in which two alternate dies are retained in the die adapter.
Figure 13:
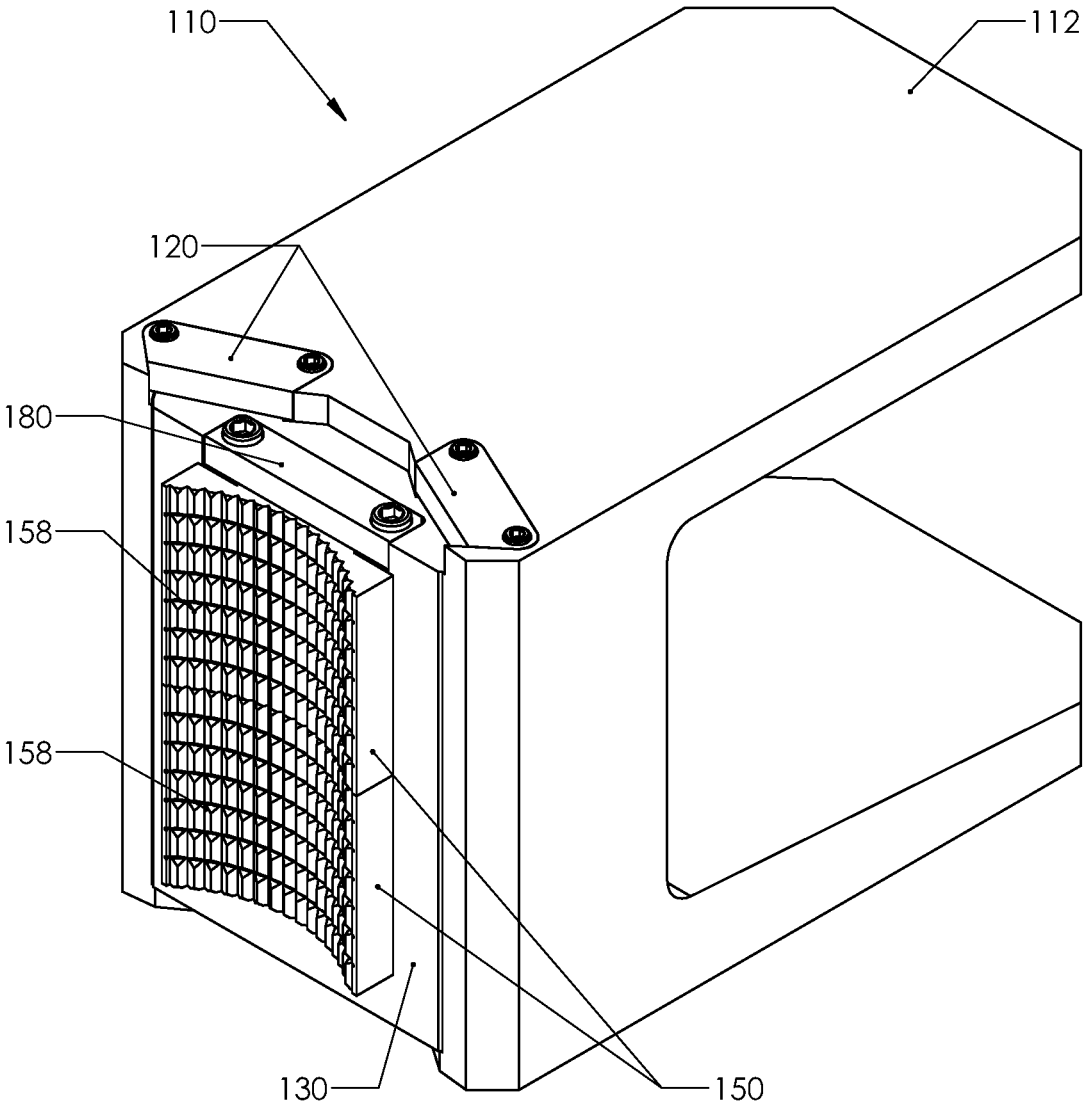
FIG. 13 is a perspective view of the adapted die carrier assembly in FIG. 12.

FIGS. 12 and 13 illustrate another embodiment of the adapted die carrier assembly. Assembly 110 includes conventional die carrier 112, die adapter 130, two alternate dies 150, and adapter plate 180. Conventional die carrier 112 includes die receptacles 114 without a central recess. Die adapter 130 includes lobes 134, receiving slot 140, and upper recess 146. Lobes 134 are reciprocal in shape to die receptacles 114. Alternate dies 150 include tapered side surfaces 152. In the illustrated embodiment, tapered side surfaces 152 of alternate dies 150 are spaced apart by less than the overall width of the alternate die 150. In this way, tapered side surfaces 152 are disposed on a rear portion that slidingly engages receiving slot 140 of die adapter 130, while a forward portion of each alternate die 150 extends forward from die adapter 130. In adapted die carrier assembly 110, two alternate dies 150 are secured within receiving slot 140 of die adapter 130 by adapter plate 180, which may be secured within upper recess 146 of die adapter 130 with fasteners engaging bores of adapter plate 180 and die adapter 130. Except as otherwise described, conventional die carrier 112, die adapter 130, alternate dies 150, and retaining plates 120 in adapted die carrier assembly 110 have the same features and function in the same way as conventional die carrier 12, die adapter 30, alternate dies 50, and retaining plates 20 in adapted die carrier assembly 10.

Adapted die carrier assembly 110 may be assembled by sliding lobes 134 of die adapter 130 into die receptacles 114 of conventional die carrier 112 and securing die adapter 130 to conventional die carrier 112 with retaining plates 120. A user may slide the first alternate die 150 into the receiving slot 140 of die adapter 130, then slide a second alternate die 150 into the receiving slot 140 above the first alternate die 150. Finally, the adapter plate 180 may be secured to die adapter 130 to secure the two alternate dies 150 within receiving slot 140. In other embodiments, the assembly steps may be accomplished in a different order.

Accordingly, the adapted die carrier assembly of the present invention may include two or more alternate dies secured to a receiving slot of the die adapter, which is slidingly secured to the conventional die carrier.

All components of the adapted die carrier assembly may be formed of any durable material, such as a metal (e.g., steel or iron), a composite, or a polymer.

Each device described in this disclosure may include any combination of the described components, features, and/or functions of each of the individual device embodiments. Each method described in this disclosure may include any combination of the described steps in any order, including the absence of certain described steps and combinations of steps used in separate embodiments. Any range of numeric values disclosed herein includes any subrange therein.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense. While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

We claim:

1. An adapted die carrier assembly for a gripping device, comprising:

a conventional die carrier including two or more die receptacles;

a die adapter secured to the conventional die carrier, wherein the die adapter includes a receiving slot and two or more lobes, wherein each of the lobes is slidingly secured within one of the die receptacles of the conventional die carrier, wherein each of the lobes has an outer surface that is reciprocal to the die receptacles;

an alternate die secured to the die adapter, wherein the alternate die is slidingly secured within the receiving slot of the die adapter, wherein the alternate die includes a gripping surface, wherein the alternate die is not configured to directly engage the die receptacles of the conventional die carrier.

2. The adapted die carrier assembly of 1, wherein the receiving slot of the die adapter includes tapered side surfaces that are reciprocal to tapered side surfaces of the alternate die.

3. The adapted die carrier assembly of 2, wherein the gripping surface of the alternate die has a concave curved profile.

4. The adapted die carrier assembly of 1, further comprising a die spacer slidingly secured within the receiving slot of the die adapter above the alternate die; wherein the die spacer includes a bore that is aligned with a bore of the die adapter; and wherein a fastener is secured within the bore of the die spacer and the bore of the die adapter to secure the die spacer to the die adapter and to retain the alternate die within the receiving slot of the die adapter.

5. The adapted die carrier assembly of 1, further comprising an adapter plate secured to the die adapter to secure the alternate die within the receiving slot of the die adapter.

6. The adapted die carrier assembly of 1, further comprising one or more retaining plates configured to engage an upper surface of the die adapter to secure the die adapter to the conventional die carrier.

7. The adapted die carrier assembly of 1, wherein each of the die receptacles of the conventional die carrier and the outer surface of each of the lobes of the die adapter has a generally cylindrical shape.

8. The adapted die carrier assembly of 7, wherein the die adapter includes two lobes and the conventional die carrier includes two die receptacles.

9. The adapted die carrier assembly of 1, further including one or more additional alternate dies each including a gripping surface; wherein each of the additional alternate dies is slidingly secured within the receiving slot of the die adapter above the alternate die; and wherein the additional alternate dies are not configured to directly engage the die receptacles of the conventional die carrier.

10. A method of modifying a conventional die carrier of a gripping device, wherein the conventional die carrier includes two or more die receptacles, the method comprising the steps of:

a) providing a die adapter comprising a receiving slot and two or more lobes, wherein each of the lobes has an outer surface that is reciprocal to the die receptacles of the conventional die carrier;

b) securing the die adapter to the conventional die carrier by sliding each of the lobes of the die adapter into one of the die receptacles of the conventional die carrier;

c) securing an alternate die to the die adapter by sliding the alternate die into the receiving slot of the die adapter, wherein the alternate die includes a gripping surface, and wherein the alternate die is not configured to directly engage the die receptacles of the conventional die carrier.

11. The method of claim 10, wherein in step (b), one or more retaining plates are used to secure the die adapter to the conventional die carrier.

12. The method of claim 10, wherein each of the die receptacles of the conventional die carrier and the outer surface of each of the lobes of the die adapter has a generally cylindrical shape.

13. The method of claim 10, wherein the receiving slot of the die adapter includes tapered side surfaces that are reciprocal to tapered side surfaces of the alternate die.

14. The method of claim 13, wherein step (c) further includes sliding a die spacer into the receiving slot of the die adapter above the alternate die and securing a fastener through a bore of the die spacer and a bore of the die adapter.

15. The method of claim 10, wherein step (c) further includes securing an adapter plate to the die adapter.

16. The method of claim 10, wherein step (c) further includes securing an additional alternate die to the die adapter by sliding the additional alternate die into the receiving slot of the die adapter, wherein the additional alternate die includes a gripping surface, and wherein the additional alternate die is not configured to directly engage the die receptacles of the conventional die carrier.

17. A die adapter for a conventional die carrier of a gripping device, wherein the conventional die carrier includes one or more die receptacles, the die adapter comprising:

two or more lobes each configured to slidingly engage one of the die receptacles of the conventional die carrier, wherein each of the lobes has an outer surface that is reciprocal to the die receptacles;

a receiving slot configured to slidingly receive and retain an alternate die that is not configured to be engaged within the die receptacles of the conventional die carrier.

18. The die adapter of claim 17, wherein the outer surface of each of the lobes is generally cylindrical.

19. The die adapter of claim 18, wherein the two or more lobes consist of two lobes.

20. The die adapter of claim 19, wherein the two lobes define sides of the die adapter.

21. The die adapter of claim 20, further comprising a central protrusion configured to engage a central recess of the conventional die carrier, wherein the central protrusion is disposed on a rear side of the die adapter between the two lobes.

22. The die adapter of claim 17, wherein the receiving slot includes tapered side surfaces.

23. The die adapter of claim 22, wherein the receiving slot extends from an open upper end to a lower surface, wherein the lower surface of the receiving slot has a larger width than the open upper end of the receiving slot.

24. An adapted die carrier assembly for a gripping device, comprising:

a conventional die carrier including one or more die receptacles;

a die adapter secured to the conventional die carrier, wherein the die adapter includes a receiving slot and one or more lobes, wherein each of the lobes is slidingly secured within one of the die receptacles of the conventional die carrier, wherein each of the lobes has an outer surface that is reciprocal to the die receptacles;

an alternate die secured to the die adapter, wherein the alternate die is slidingly secured within the receiving slot of the die adapter, wherein the alternate die includes a gripping surface, wherein the alternate die is not configured to directly engage the die receptacles of the conventional die carrier;

a die spacer slidingly secured within the receiving slot of the die adapter above the alternate die; wherein the die spacer includes a bore that is aligned with a bore of the die adapter; and wherein a fastener is secured within the bore of the die spacer and the bore of the die adapter to secure the die spacer to the die adapter and to retain the alternate die within the receiving slot of the die adapter.

25. An adapted die carrier assembly for a gripping device, comprising:

a conventional die carrier including one or more die receptacles;

a die adapter secured to the conventional die carrier, wherein the die adapter includes a receiving slot and one or more lobes, wherein each of the lobes is slidingly secured within one of the die receptacles of the conventional die carrier, wherein each of the lobes has an outer surface that is reciprocal to the die receptacles;

an alternate die secured to the die adapter, wherein the alternate die is slidingly secured within the receiving slot of the die adapter, wherein the alternate die includes a gripping surface, wherein the alternate die is not configured to directly engage the die receptacles of the conventional die carrier;

one or more retaining plates configured to engage an upper surface of the die adapter to secure the die adapter to the conventional die carrier.

26. An adapted die carrier assembly for a gripping device, comprising:

a conventional die carrier including one or more die receptacles;

a die adapter secured to the conventional die carrier, wherein the die adapter includes a receiving slot and one or more lobes, wherein each of the lobes is slidingly secured within one of the die receptacles of the conventional die carrier, wherein each of the lobes has an outer surface that is reciprocal to the die receptacles;

an alternate die secured to the die adapter, wherein the alternate die is slidingly secured within the receiving slot of the die adapter, wherein the alternate die includes a gripping surface, wherein the alternate die is not configured to directly engage the die receptacles of the conventional die carrier;

wherein each of the die receptacles of the conventional die carrier and the outer surface of each of the lobes of the die adapter has a generally cylindrical shape.

27. An adapted die carrier assembly for a gripping device, comprising:

a conventional die carrier including one or more die receptacles;

a die adapter secured to the conventional die carrier, wherein the die adapter includes a receiving slot and one or more lobes, wherein each of the lobes is slidingly secured within one of the die receptacles of the conventional die carrier, wherein each of the lobes has an outer surface that is reciprocal to the die receptacles;

an alternate die secured to the die adapter, wherein the alternate die is slidingly secured within the receiving slot of the die adapter, wherein the alternate die includes a gripping surface, wherein the alternate die is not configured to directly engage the die receptacles of the conventional die carrier;

one or more additional alternate dies each including a gripping surface; wherein each of the additional alternate dies is slidingly secured within the receiving slot of the die adapter above the alternate die; and wherein the additional alternate dies are not configured to directly engage the die receptacles of the conventional die carrier.

28. A die adapter for a conventional die carrier of a gripping device, wherein the conventional die carrier includes one or more die receptacles, the die adapter comprising:

one or more lobes each configured to slidingly engage one of the die receptacles of the conventional die carrier, wherein each of the lobes has an outer surface that is reciprocal to the die receptacles;

a receiving slot configured to slidingly receive and retain an alternate die that is not configured to be engaged within the die receptacles of the conventional die carrier;

wherein the outer surface of each of the lobes is generally cylindrical.

29. A method of modifying a conventional die carrier of a gripping device, wherein the conventional die carrier includes one or more die receptacles, the method comprising the steps of:

a) providing a die adapter comprising a receiving slot and one or more lobes, wherein each of the lobes has an outer surface that is reciprocal to the die receptacles of the conventional die carrier;

b) securing the die adapter to the conventional die carrier by sliding each of the lobes of the die adapter into one of the die receptacles of the conventional die carrier, wherein one or more retaining plates is used to secure the die adapter to the conventional die carrier;

c) securing an alternate die to the die adapter by sliding the alternate die into the receiving slot of the die adapter, wherein the alternate die includes a gripping surface, and wherein the alternate die is not configured to directly engage the die receptacles of the conventional die carrier.

30. A method of modifying a conventional die carrier of a gripping device, wherein the conventional die carrier includes one or more die receptacles, the method comprising the steps of:

a) providing a die adapter comprising a receiving slot and one or more lobes, wherein each of the lobes has an outer surface that is reciprocal to the die receptacles of the conventional die carrier;

b) securing the die adapter to the conventional die carrier by sliding each of the lobes of the die adapter into one of the die receptacles of the conventional die carrier;

c) securing an alternate die to the die adapter by sliding the alternate die into the receiving slot of the die adapter, sliding a die spacer into the receiving slot of the die adapter above the alternate die, and securing a fastener through a bore of the die spacer and a bore of the die adapter, wherein the alternate die includes a gripping surface, and wherein the alternate die is not configured to directly engage the die receptacles of the conventional die carrier;

wherein the receiving slot of the die adapter includes tapered side surface that are reciprocal to tapered side surfaces of the alternate die.

31. A method of modifying a conventional die carrier of a gripping device, wherein the conventional die carrier includes one or more die receptacles, the method comprising the steps of:

a) providing a die adapter comprising a receiving slot and one or more lobes, wherein each of the lobes has an outer surface that is reciprocal to the die receptacles of the conventional die carrier;

b) securing the die adapter to the conventional die carrier by sliding each of the lobes of the die adapter into one of the die receptacles of the conventional die carrier;

c) securing an alternate die to the die adapter by sliding the alternate die into the receiving slot of the die adapter, wherein the alternate die includes a gripping surface, and wherein the alternate die is not configured to directly engage the die receptacles of the conventional die carrier;

wherein each of the die receptacles of the conventional die carrier and the outer surface of each of the lobes of the die adapter has a generally cylindrical shape.

32. A method of modifying a conventional die carrier of a gripping device, wherein the conventional die carrier includes one or more die receptacles, the method comprising the steps of:

a) providing a die adapter comprising a receiving slot and one or more lobes, wherein each of the lobes has an outer surface that is reciprocal to the die receptacles of the conventional die carrier;

b) securing the die adapter to the conventional die carrier by sliding each of the lobes of the die adapter into one of the die receptacles of the conventional die carrier;

c) securing an alternate die to the die adapter by sliding the alternate die into the receiving slot of the die adapter and securing an additional alternate die to the die adapter by sliding the additional alternate die into the receiving slot of the die adapter, wherein the alternate die includes a gripping surface, wherein the alternate die is not configured to directly engage the die receptacles of the conventional die carrier, wherein the additional alternate die includes a gripping surface, and wherein the additional alternate die is not configured to directly engage the die receptacles of the conventional die carrier.

* * * * *